US007093627B2

(12) United States Patent
Chuang

(10) Patent No.: US 7,093,627 B2
(45) Date of Patent: Aug. 22, 2006

(54) QUICK SHIFTING AND MICRO-ADJUSTING DEVICE FOR THE ANGLE BLOCKING PLATE OF A PLANING MACHINE

(76) Inventor: Bor-Yann Chuang, No. 78, Yungfeng Rd., Taiping Shiang, Taichung (TW) 411

( * ) Notice: Subject to any disclaimer, the term of this patent is extended or adjusted under 35 U.S.C. 154(b) by 0 days.

(21) Appl. No.: 11/011,122

(22) Filed: Dec. 15, 2004

(65) Prior Publication Data

US 2006/0124201 A1 Jun. 15, 2006

(51) Int. Cl.
*B27C 5/04* (2006.01)
*B27C 1/00* (2006.01)

(52) U.S. Cl. ..... 144/253.8; 144/114.1; 144/286.5

(58) Field of Classification Search ..... 144/253.1, 144/253.5–253.8, 114.1, 117.1, 286.5; 269/303, 269/315, 318; 409/229
See application file for complete search history.

(56) References Cited

U.S. PATENT DOCUMENTS 2,872,957 A * 2/1959 Eschenburg ..... 144/253.8
5,533,557 A * 7/1996 Jedlicka et al. ..... 144/253.8
2005/0051238 A1* 3/2005 Chuang ..... 144/114.1

* cited by examiner

*Primary Examiner*—Derris H. Banks
*Assistant Examiner*—Shelley Self
(74) *Attorney, Agent, or Firm*—Troxell Law Office, PLLC

(57) ABSTRACT

A quick shifting and micro-adjusting device for the angle blocking plate of a planing machine includes a material conveying table connected with a fundamental base having a support member extending downward. A shaft able to slide axially has its inner end inserted through the support member and its outer end connected with a hand wheel. A transmission gear is firmly fitted on the intermediate portion of the shaft, having its upper portion properly protruding out of the upper side of fundamental base and able to move together with the shaft. An upper holding frame assembled on the fundamental base has a rack able to be engaged with or disengaged from the transmission gear. Thus, the angle block plate can be shifted quickly and micro-adjusted accurately by pushing, pulling and turning of the hand wheel.

4 Claims, 7 Drawing Sheets

QUICK SHIFTING AND MICRO-ADJUSTING DEVICE FOR THE ANGLE BLOCKING PLATE OF A PLANING MACHINE

BACKGROUND OF THE INVENTION

1. Field of the Invention

This invention relates to a planing machine, particularly to one provided with a device for quickly shifting and micro-adjusting its angle blocking plate.

2. Field of the Invention

Generally, a conventional planing machine includes a material conveying table having a fundamental base secured on one side. An upper holding frame able to slide forward and backward is disposed on the fundamental base and has one side connected with an angle blocking plate able to slide forward and backward together with the upper holding frame on the material conveying table. The angle blocking plate is provided for positioning a wood material during planing work.

However, the upper holding frame and the angle blocking plate of the conventional planing machine are pushed and pulled manually for shifting forward and backward. Although the angle blocking plate can be quickly pushed and pulled manually to move forward and backward, yet it cannot be micro-adjusted with precision, inconvenient in operating and necessary to take much time to accurately adjust the angle blocking plate in position.

SUMMARY OF THE INVENTION

The objective of the invention is to offer a quick shifting and micro-adjusting device for the angle blocking plate of a planing machine, able to adjust the angle blocking plate of a planing machine quickly and accurately.

The quick shifting and micro-adjusting device for the angle blocking plate of a planing machine in the present invention includes a material conveying table connected with a fundamental base having a support member extending downward. A shaft able to slide axially has its inner end inserted through the support member and its outer end connected with a hand wheel. A transmission gear is firmly fitted on the intermediate portion of the shaft, having its upper portion properly protruding out of the upper side of the fundamental base and able to move axially together with the shaft. An upper holding frame assembled on the fundamental base has its underside provided with a lengthwise rack able to be engaged with or disengaged from the transmission gear. Thus, when the hand wheel is pulled to an outermost position, the transmission gear and the rack will be disengaged from each other, and the upper holding frame and the angle blocking plate can be quickly shifted. When the hand wheel is pushed to an innermost position, the transmission gear and the rack will be engaged with each other, and the upper holding frame and the angle blocking plate can be micro-adjusted by turning the hand wheel.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
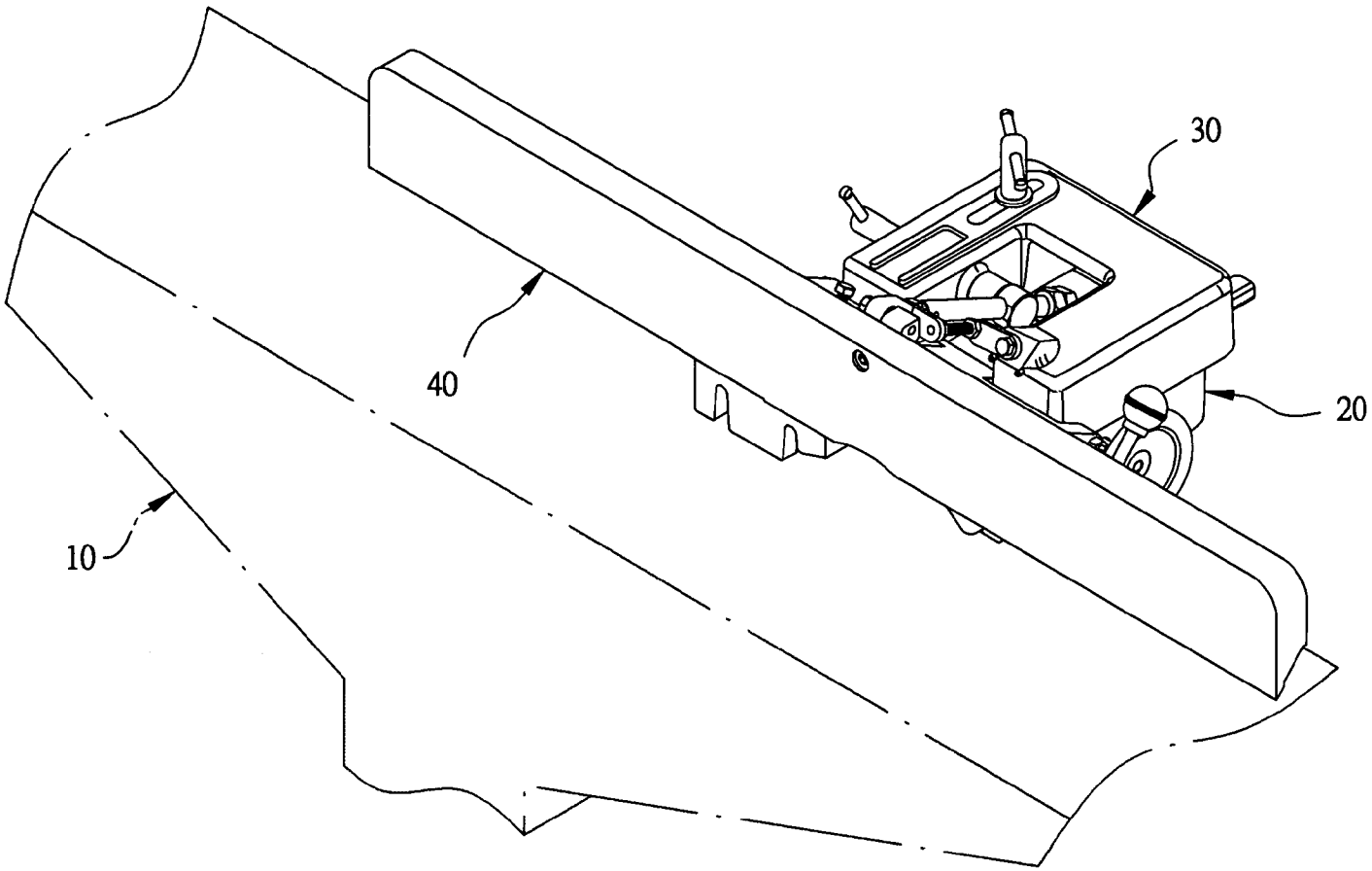
FIG. 1 is a partial perspective view of a planing machine in the present invention.
Figure 2:
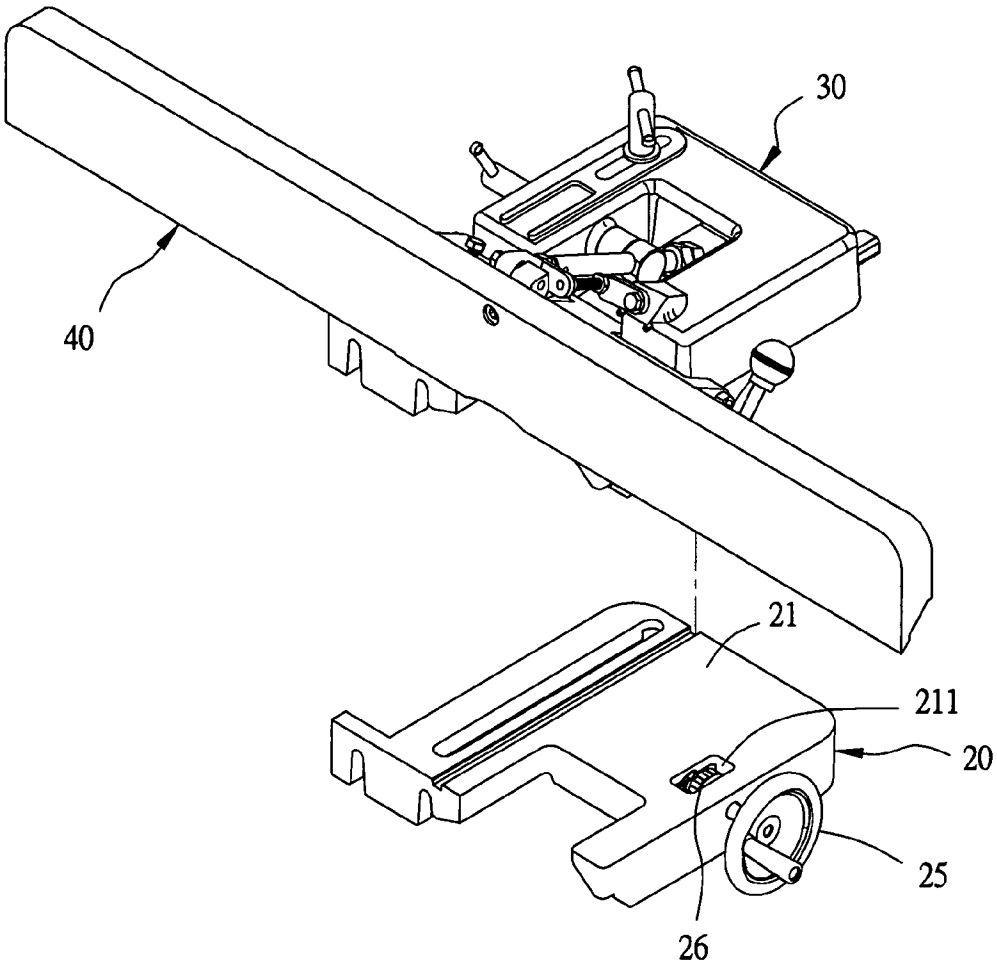
FIG. 2 is a partial exploded perspective view of a quick shifting and micro-adjusting device for the angle blocking plate of a planing machine in the present invention.

A preferred embodiment of a quick shifting and micro-adjusting device for the angle blocking plate of a planing machine in the present invention, as shown in FIGS. 1 and 2, includes a material conveying table 10, a fundamental base 20, an upper holding frame 30 and angle blocking plate 40 as main components combined together. The fundamental base 20 is connected with one side of the material conveying table 10. The upper holding frame 30 is disposed on the fundamental base 20, able to be guided to move forward and backward. The angle blocking plate 40 is connected with one side of the upper holding frame 30, able to be shifted forward and backward together with the upper holding frame 30 on the material-conveying table 10 for positioning a wood material during planing work.

Figure 3:
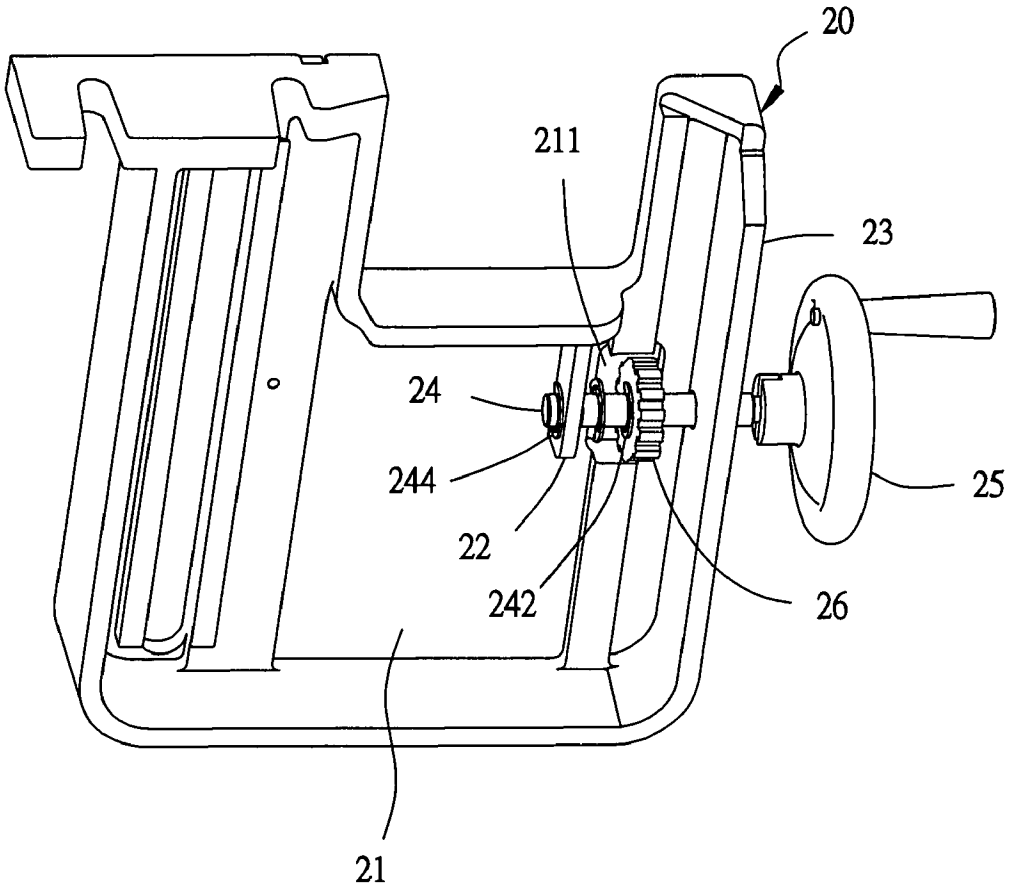
FIG. 3 is a perspective view of the underside of a fundamental base of the quick shifting and micro-adjusting device for the angle blocking plate of a planing machine in the present invention.
Figure 4:
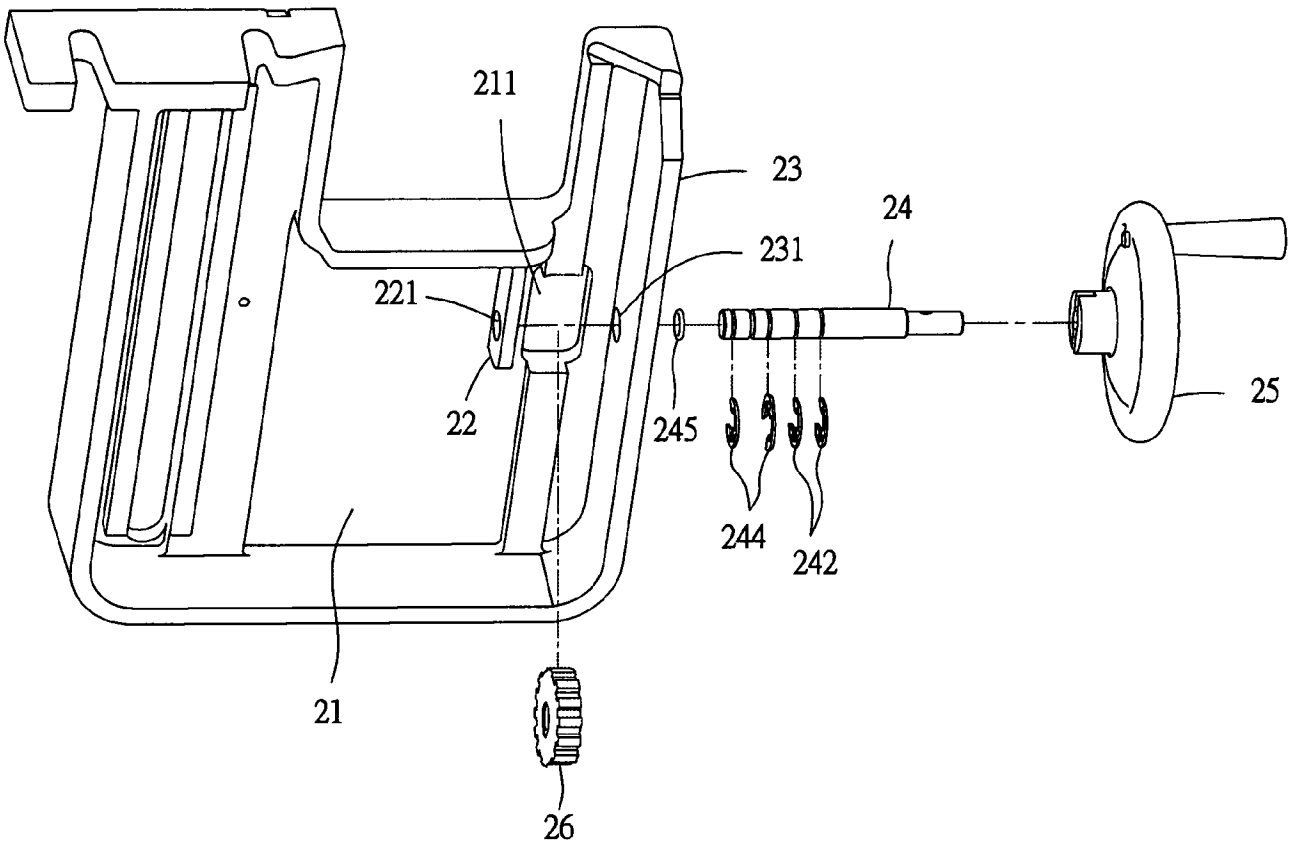
FIG. 4 is an exploded perspective view of the underside of the fundamental base of the quick shifting and micro-adjusting device for the angle blocking plate of a planing machine in the present invention.

The fundamental base 20, as shown in FIGS. 3 and 4, has the underside wall of its top plate 21 fixed with a support member 22 extending downward from a proper location and transversely bored with a shaft hole 221. Further, the fundamental base 20 has one side plate 23 opposite to the support member 22 bored transversely with an insert hole 231 aligned to the shaft hole 221 of the support member 22 for a shaft 24 to be inserted therethrough. The shaft 24 has its outer end 241 inserted through the insert hole 231 and connected with a hand wheel 25. A transmission gear 26 is fitted around the intermediate portion of the shaft 24 and secured thereon by two washers 242, having its lower portion positioned in a hollowed groove 211 bored in the top plate 21 of the fundamental base 20 and its upper portion properly extending out of the topside of the fundamental base 20. The shaft 24 has its inner end 243 axially inserted through the shaft hole 221 of the support member 22 under the top plate 21 of the fundamental base 20 and fitted thereon with two helical spring lock washers 244 respectively positioned at the opposite sides of the support member 22. A washer 245 having an outer diameter a little larger than the inner diameter of the shaft hole 221 is fitted on the inner end 243 of the shaft 24 between the two helical spring lock washers 244. Thus, after the washer 245 is fitted in the shaft hole 221 of the support member 22, there will produce a frictional force between the washer 245 and the inner wall of the shaft hole 221. In addition, the width between the opposite sides of the washer and the helical spring lock washers 244 is approximately equivalent to the length between two ends of the shaft hole 221 so as to enable the shaft hole 221 to slide and position at a region between the washer 245 and either of the two helical spring lock washers 244.

Figure 5:
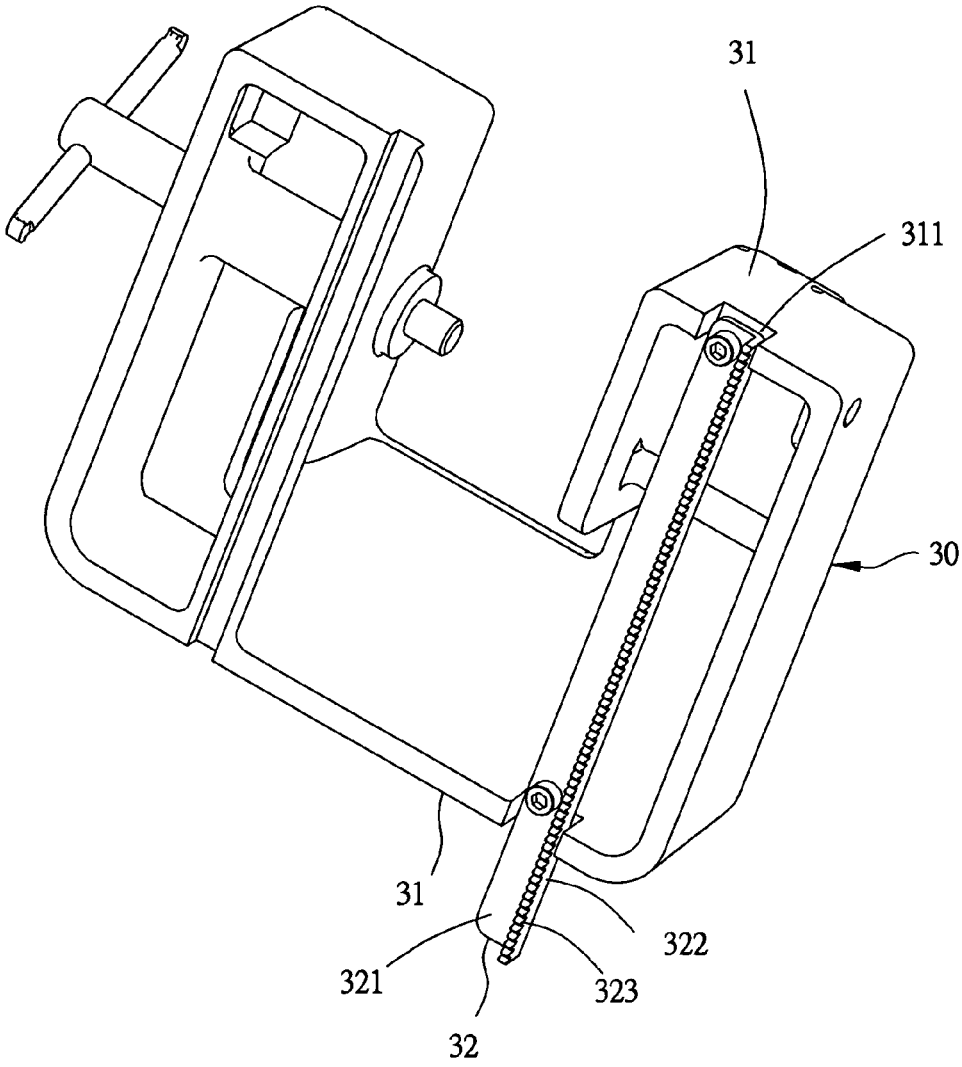
FIG. 5 is a perspective view of the underside of an upper holding frame of the quick shifting and micro-adjusting device for the angle blocking plate of a planing machine in the present invention.

The upper holding frame 30, as shown in FIG. 5, has the underside wall of its front and rear side plate 31 respective bored with a receptive recess 311 for receiving the opposite ends of a rack 32. The rack 32 has an L-shaped cross section formed with an upper side 321 and a lateral side 322. The upper side 321 has its opposite ends respectively received in the two receptive recesses 311, and the lateral side 322 has its lower edge formed with a row of teeth 323 able to be engaged with or disengaged from the transmission gear 26 on the fundamental base 20.

Figure 6:
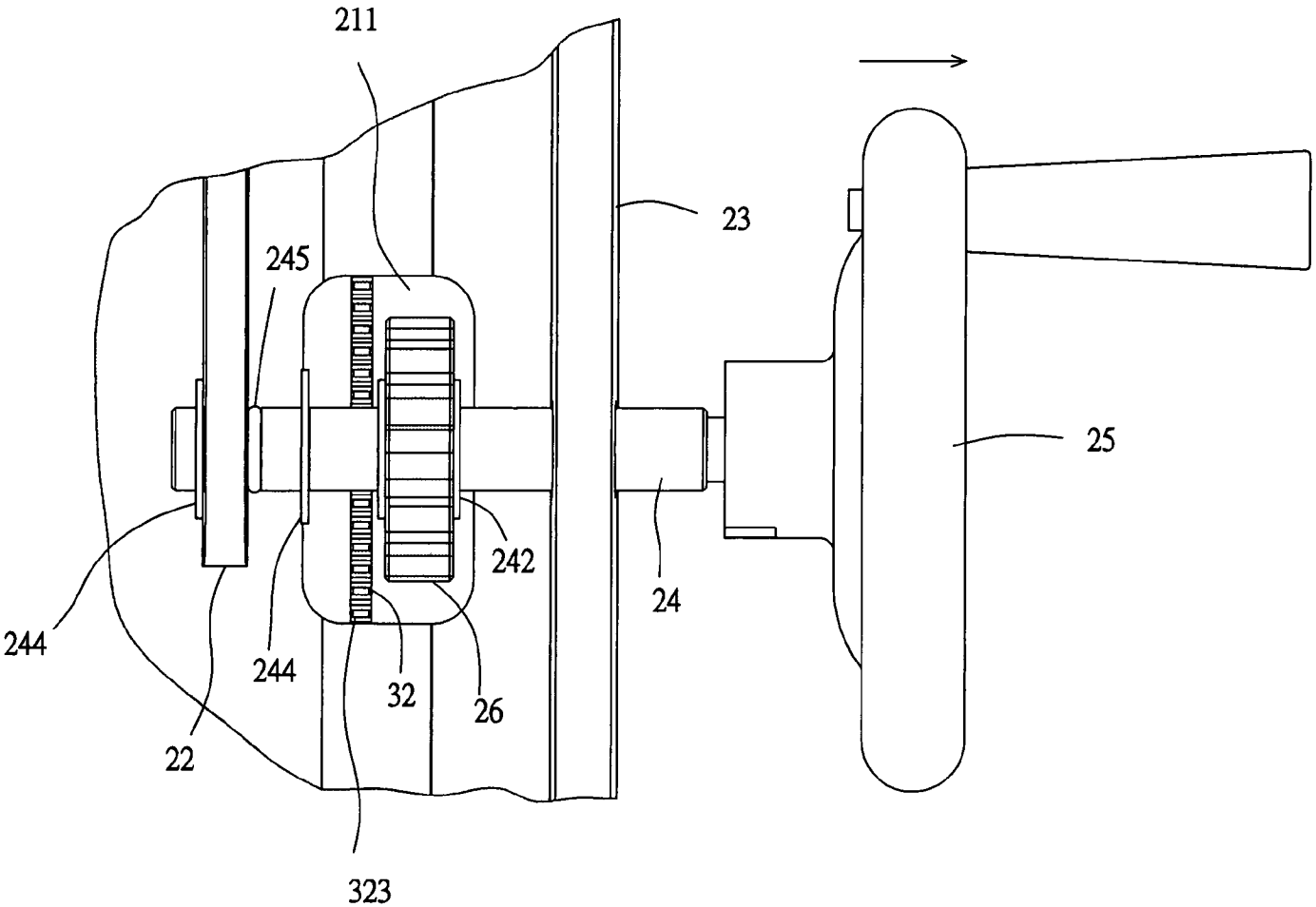
FIG. 6 is a bottom view of the quick shifting and micro-adjusting device for the angle blocking plate of a planing machine in the present invention, showing that a transmission gear and a rack are disengaged from each other.

In operating, as shown in FIGS. 1 and 6, firstly, a wood material to be planed is placed on the material conveying table 10 and then the hand wheel 25 is pulled outward to let the helical spring lock washers 244 on the inner end of the shaft 24 resist against the inner wall of the support member 22, letting the hand wheel 25 be positioned at an outmost side. At this time, the transmission gear 26 on the shaft 24 is moved transversely and disengaged from the rack 32 of the upper holding frame 30; therefore, the upper holding frame 30 and the angle blocking plate 40 can be easily and quickly shift manually. In the meantime, the washer 245 and the shaft 24 between the washer 245 and the inner washer 245 and the inner helicals spring lock washers 244 are inserted in the shaft hole 221 of the support member 22, and there produces a transverse frictional resistance between the washer 245 and the inner wall of the shaft hole 221. Therefore, the shaft 24 can be prevented from moving inward and the transmission gear 26 and the rack 32 can be kept in a disengaged condition for facilitating quick shifting of the upper holding frame 30 and the angle blocking plate 40.

Figure 7:
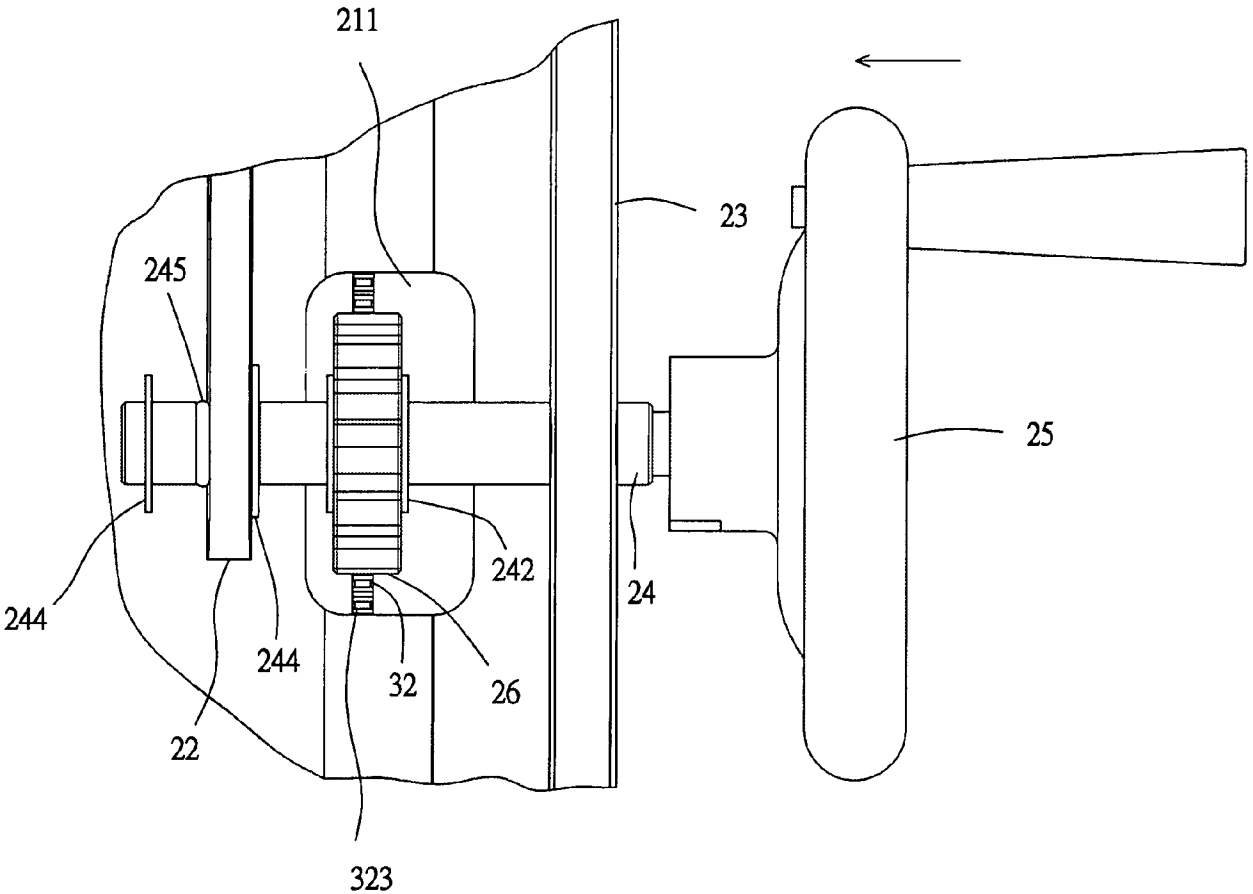
FIG. 7 is a bottom view of the quick shifting and micro-adjusting device for the angle blocking plate of a planing machine in the present invention, showing that the transmission gear is engaged with the rack.

Referring to FIG. 7, when the wood material is quickly moved together with the angle blocking plate 40 to a suitable location for planing, the hand wheel 25 is pushed inward to let the outer helical spring lock washers 244 on the shaft 24 resist against the outer wall of the support member 22, letting the hand wheel 25 be positioned at an innermost side. Simultaneously, the transmission gear 26 on the shaft 24 is transversely moved to the underside of the rack 32 and engaged with the rack 32. At this time, the hand wheel 25 can easily be turned around by a user to precisely micro-adjust the position of the upper holding frame 30 and the angle blocking plate 40 and accurately position the wood material for carrying out planing. Meanwhile, the washer 245 and the shaft 24 between the washer 245 and the outer helical spring lock washers 244 are inserted in the shaft hole 221 of the support member 22 and there produces a frictional resistance between the washer 245 and the inner wall of the shaft hole 221; therefore, the shaft 24 can be prevented from moving outward, and the transmission gear 26 and the rack 32 can be kept in an engaged condition for facilitating micro-adjustment of the angle blocking plate 40.

To sum up, this invention has the following advantages.

1. The angle blocking plate 40 of this invention has two functions of quick shift and micro-adjustment, able to quickly and accurately position a wood material for planing.

2. The angle blocking plate 40 can be quickly shifted or micro-adjusted only by pulling outward or pushing inward the hand wheel 25, able to vary operation easily and quickly.

3. The proper resistance of the helical spring lock washers 244 on the shaft 24 to the support member 22 and the transverse frictional resistance produced between the washer 245 and the inner wall of the shaft hole 221 of the support member 22 enable the transmission gear 26 and the rack 32 to be steadily kept in a disengaged or in an engaged condition, facilitating quick shift or micro-adjustment of the angle blocking plate 40.

While the preferred embodiment of the invention has been described above, it will be recognized and understood that various modifications may be made therein and the appended claims are intended to cover all such modifications that may fall within the spirit and scope of the invention.

I claim:

1. A quick shaft and micro-adjusting device for the angle blocking plate of a planing machine comprising: a material conveying table, said material conveying table having one side connected with a fundamental base, said fundamental base provided thereon with an upper holding frame able to be guided to shift forward and backward, said upper holding frame having one side connected with an angle blocking plate, said angle blocking plate able to shift forward and backward together with said upper holding frame on said material conveying table, said angle blocking plate provided for positioning a wood material during planing work;

said fundamental base having an underside wall of a top fixed with a support member extending downward, a shaft inserted through both one side plate of said fundamental base and said support member, said shaft having an outer end extending out of said side plate of said fundamental base and connected with a hand wheel, said shaft having an intermediate portion firmly fitted with a transmission gear, said transmission gear received in a hollowed groove bored in the upper side of said top plate of said fundamental base, said transmission gear having an upper portion protruding out of the upper side of said fundamental base, said shaft having an inner end inserted through said support member, two helical spring lock washers fixed on said shaft and respectively positioned at the opposite sides of said support member, said helical spring lock washers provided for stopping and restricting said shaft in position when said shaft shifts axially; and said upper holding frame having an underside provided with a lengthwise rack, said rack able to be moved and disengaged from said transmission gear on said shaft of said fundamental base to enable said upper holding frame and said angle blocking plate to be quickly moved forward and backward, said rack also able to be moved and engaged with said transmission gear to enable said angle blocking plate to be micro-adjusted in position by turning said hand wheel.

2. The quick shifting and micro-adjusting device for the angle blocking plate of a planing machine as claimed in claim 1, wherein said helical spring lock washers are C-shaped retainers.

3. The quick shift and micro-adjusting device for the angle blocking plate of a planing machine as claimed in claim 1, wherein said support member is bored with a shaft hole for said inner end of said shaft to be inserted therethrough, and said shaft between two said helical spring lock washers is fitted thereon with a washer having an outer diameter a little larger than the inner diameter fo said shaft hole of said support member, the width between the opposite sides of an O-shaped ring and said helical spring lock washers approximately equivalent to the length between two ends of said shaft equivalent to the length between two ends of said shaft hole, said shaft hole able to slide and position at a region between said washer and either of said two helical spring lock washers, a transverse frictional resistance formed between said washer and the inner wall of said shaft hole to prevent said shaft form moving freely.

4. The quick shift and micro-adjusting device for the angle blocking plate of a planing machine as claimed in claim 1, wherein said upper holding frame has the underside wall of a front and rear side plate respectively bored with a receiving recess, and said rack has an L-shaped cross section formed with an upper side and a lateral side, said upper side of said rack having its opposite ends respectively received in said two receptive recesses of said upper holding frame, said lateral side of said rack having its lower edge formed with a row of teeth, said teeth able to be properly engaged with said transmission gear on said fundamental base.

* * * * *